US006585098B2

(12) United States Patent
Satou et al.

(10) Patent No.: US 6,585,098 B2
(45) Date of Patent: Jul. 1, 2003

(54) BILL-RECEIVING/DISCHARGING DEVICE AND BILL-HANDLING APPARATUS WITH THE BILL-RECEIVING/DISCHARGING DEVICE

(75) Inventors: Tadashi Satou, Chiyoda (JP); Yasunari Niioka, Seto (JP); Riichi Katou, Nagoya (JP); Kazushi Yoshida, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 156 days.

(21) Appl. No.: 09/769,280

(22) Filed: Jan. 26, 2001

(65) Prior Publication Data

US 2001/0022258 A1 Sep. 20, 2001

(30) Foreign Application Priority Data

Mar. 17, 2000 (JP) ..... 2000-081745

(51) Int. Cl.[7] ..... G07F 7/04; B65H 29/66

(52) U.S. Cl. ..... 194/206; 271/216

(58) Field of Search ..... 194/206, 344, 194/353, 205; 198/347.3; 271/204, 216

(56) References Cited

U.S. PATENT DOCUMENTS

| | | | | | |
|---|---|---|---|---|---|
| 3,683,943 | A | * | 8/1972 | De Crepy | 194/206 |
| 4,438,618 | A | * | 3/1984 | Honegger | 53/430 |
| 4,509,703 | A | * | 4/1985 | Grunder | 198/347.3 |
| 4,525,982 | A | * | 7/1985 | Meier | 53/430 |
| 4,526,362 | A | * | 7/1985 | Thierstein | 271/186 |
| 4,538,397 | A | * | 9/1985 | Boss | 53/430 |
| 4,589,603 | A | * | 5/1986 | Muller | 242/528 |
| 4,595,192 | A | * | 6/1986 | Reist | 271/184 |
| 4,768,768 | A | * | 9/1988 | Reist | 270/60 |
| 4,775,111 | A | * | 10/1988 | Kalin | 242/528 |
| 4,822,018 | A | * | 4/1989 | Hain | 270/60 |
| 4,928,899 | A | * | 5/1990 | Reist | 242/528 |
| 5,029,843 | A | * | 7/1991 | Kobler | 198/347.3 |
| 5,228,670 | A | * | 7/1993 | Kobler | 271/3.14 |
| 5,735,516 | A | * | 4/1998 | Gerlier et al. | 209/534 |
| 6,019,209 | A | * | 2/2000 | Hara et al. | 194/206 |
| 6,371,473 | B1 | * | 4/2002 | Saltsov et al. | 194/206 |

FOREIGN PATENT DOCUMENTS

| | | | | |
|---|---|---|---|---|
| CH | 667635 A5 | * | 10/1988 | B65H/5/28 |
| JP | 5-201509 A | * | 8/1993 | B65H/29/51 |
| JP | 8-96191 | | 4/1996 | |
| JP | 08-096191 A1 | * | 12/1996 | G07D/1/00 |

* cited by examiner

*Primary Examiner*—Donald P. Walsh
*Assistant Examiner*—Mark J Beauchaine
(74) *Attorney, Agent, or Firm*—Antonelli, Terry, Stout & Kraus, LLP

(57) ABSTRACT

A bill-receiving/discharging device for storing bills in their shorter-side direction by using one small-width tape has a problem that a corner of a bill is highly lifted due to folds of the bill when discharged, because a distance from a tape-holding point to a bill end is large in the axial direction, and the bill corner causes edge folding that the bill is folded like a triangle, and the bill cannot normally discharged to the outside of the device. The invention solves the above problem by the structure that comprises a wheel for winding a tape together with bills at the central portion of a transfer route for carrying the bills, a reel for winding the tape let out from the wheel, and a guide unit for guiding front ends of the bills discharged from the wheel together with the tape, which extends from an end in the width direction of the tape toward a width direction of the bill transfer route.

10 Claims, 7 Drawing Sheets

BILL-RECEIVING/DISCHARGING DEVICE AND BILL-HANDLING APPARATUS WITH THE BILL-RECEIVING/DISCHARGING DEVICE

BACKGROUND OF THE INVENTION

The present invention relates to a bill-handling apparatus for receiving or discharging bills, particularly to a bill-receiving/discharging device for receiving or discharging bills by winding or rewinding a tape between wheels or reels.

In bill-handling apparatuses for receiving or discharging bills, some apparatuses are provided with bill-receiving/discharging devices for receiving bills by winding a tape and the bills on a wheel or discharging the bills by rewinding the tape on a reel. A bill-receiving/discharging device of the above configuration has an advantage that it is possible to realize a simple-structure, compact, and low-cost device. For example, JP-A-8-96191 discloses a device featuring auxiliary means for receiving/paying out bills in addition to a configuration in which a tape is wound on a wheel and a reel.

SUMMARY OF THE INVENTION

The above conventional example is of a system for receiving/discharging a bill in the longitudinal or longer-side direction thereof and the width of a roller for winding the bill as well as a tape for winding the bill is adapted to the size in the width or shorter-side direction of the bill. In this conventional art, the axial direction of a winding roller is the same as the shorter-side direction of the bill. Accordingly, even when the width of a tape is designed to be small, the tape width and the ends of a bill in the axial direction of the roller is in such a relation that the distances from a holding point of the bill by the tape to the bill ends are comparatively small. As a result, winding of the bill is hardly influenced by its folds or curl.

The above-described conventional system of receiving or discharging a bill in the longitudinal direction of the bill described above has a problem that the rate for the outer-periphery diameter of a wheel to increase is large and thereby, a device cannot be made compact. Therefore, a system of receiving bills in the shorter-side direction thereof has been considered and examined, and it is found to have an advantage that it is possible to reduce the increase of the diameter of a winding roller for the same number of bills and make a bill-receiving/discharging device as compared with the system of receiving bills in the longitudinal direction thereof. This is because that the length of a bill in its width direction is smaller than that in the longitudinal direction of the bill.

By the way, a bill-handling apparatus provided with such a bill-receiving/discharging device as described above tends to increase the number of bills and the number of denominations, which the apparatus can handle, the relation between a tape and bills becomes an issue in the bill-receiving/discharging device of receiving/discharging bills in the width direction thereof, because it handles large and small worthy bills in a mingled manner.

In the case of a system using one winding tape at the center, if providing a tape width for covering the longer side of a bill, which is in a direction perpendicular to the transfer direction of the bill as described in the above conventional art, an inertial load applied to rotation of a wheel for winding a tape and the bills becomes excessively large. Moreover, a system using two tapes or more in the axial direction of a wheel has a problem that the imbalance between the right and left sides of a bill when received occurs because of a deviation of the bill when received. Therefore, to make the structure compact while handling large and small worthy bills of various sorts mixed, a system of receiving bills in the shorter-side direction thereof, constructed to have a slender winding tape at the center, is most suitable for the structure of a bill-receiving/discharging device.

However, if the system is formed with a small-width tape, there is a problem that a corner of a bill is highly lifted due to folds of the bill when discharged, because the distance from a tape holding point to bill ends in the rotating-shaft direction of a wheel. When a so-called edge folding occurs, namely the bill corner is folded like a triangle, it is impossible to normally discharge the bill to the outside of an apparatus.

To solve the above problems, a bill-receiving/discharging device of the present invention is provided with a wheel for winding a tape together with a bill at the center in the width direction of a bill transfer route through which the bill is carried in its shorter-side direction and a reel for winding the tape let out from the wheel and has guide means for guiding the front end of the bill discharged together with the tape let out from the wheel in the direction of the carrying plane of the bill transfer route.

With the above configuration, even in a state that a bill corner is highly lifted due to folds of a bill, it is possible to hold down the lifting of the bill, because the guide means contacts the front end of the bill from the vicinity of the center of the bill in the carrying direction where a lift of the bill is small.

Moreover, it is effective that the guide means comprises first guide means movable when the outside diameter of the wheel is changed due to winding of the tape and fixed second guide means.

Furthermore, to solve the above other problem, a bill-handling apparatus of the invention is provided with a bill-handling port through which bills are received and paid out, a transfer route for carrying the bills from the bill-handling port in the shorter-side direction of the bills, a discriminating device for judging the bills carried through the transfer route, a storing cassette connected to the transfer route for storing the bills so that they can be paid out, and a bill-receiving/discharging device for temporarily storing the bills judged by the discriminating device, and the bill-receiving/discharging device comprises a wheel for winding a tape together with bills at the central portion of a transfer route through which the bills are carried in the shorter-side direction thereof, a reel for winding the tape let out from the wheel, and guide means extending in the width direction of the bill transfer route from the ends in the width direction of the tape to guide the front ends of the bills discharged together with the tape let out from the wheel in the direction of the bill transfer route.

DESCRIPTION OF THE PREFERRED EMBODIMENTS

Figure 13:
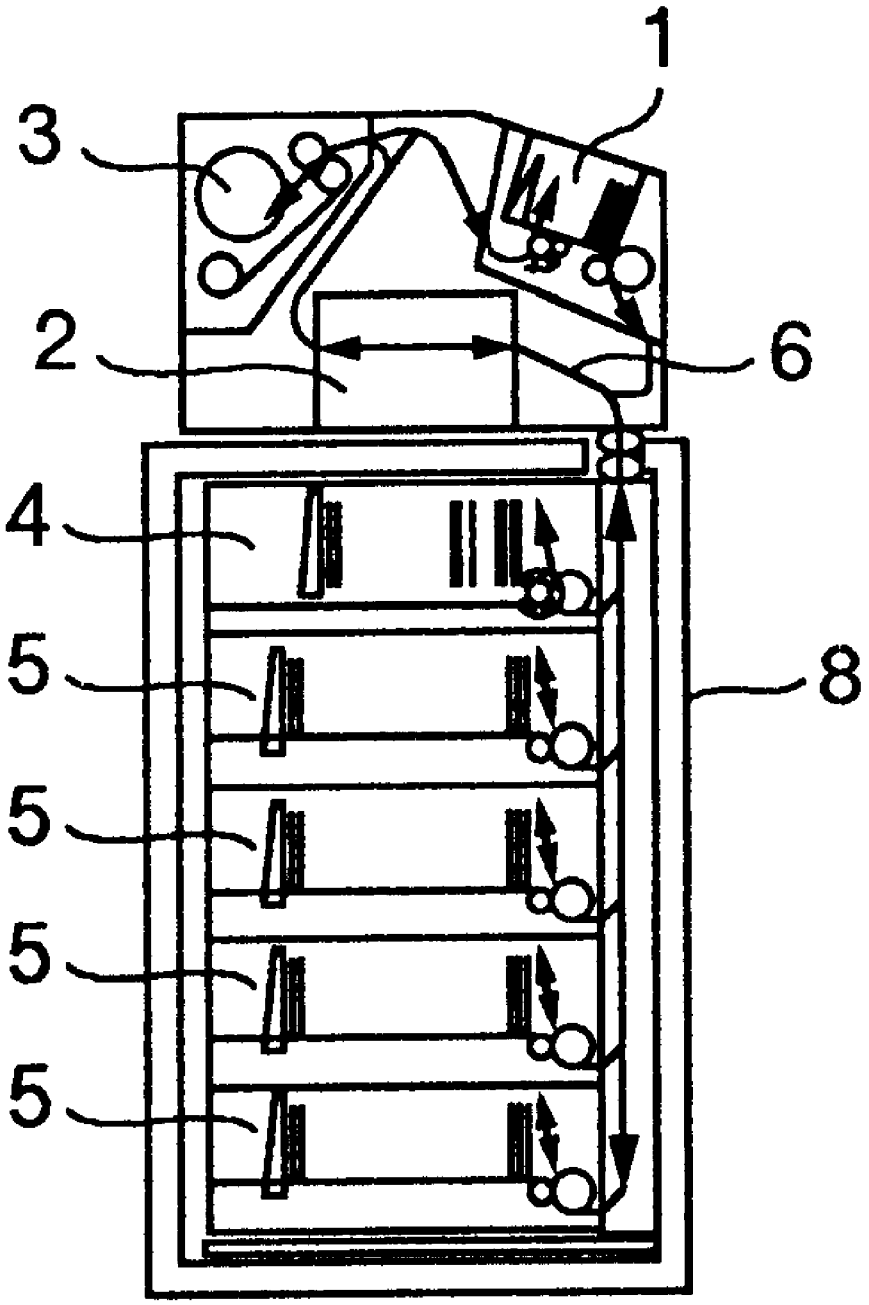
FIG. 13 is a schematic view of a bill-handling apparatus according to an embodiment of the invention.

An embodiment of a bill-handling apparatus to which the present invention is applied will be described below. FIG. 13 is a sectional view of a portion in the bill-handling apparatus 8, to which a bill-receiving/discharging device 3 is applied. Hereinafter, description will be made along the flowing of a bill for a money receiving mode.

When bills are put into a money-receiving/paying-out port 1 for handling various kinds of bills mingled, they are separated from each other at the money-receiving/paying-out port 1 and let out to a transfer route 6. The let-out bills pass through the transfer route 6 and denominations of the bills are classified by a discriminating device 2 and then, the bills of various denominations are temporarily stored in a bill-receiving/discharging device 3.

In accordance with a judgement result of the discriminating device 2, the amount of money of the bills simultaneously put into the money-receiving/paying-out port 1 is advised through an indication device, not shown, to a person who paid the money. When the amount of money is confirmed and the money-receiving mode is effectuated, the bills of various denominations are discharged from the bill-receiving/discharging device 3, pass through the transfer route 6 and are stored in recycle cassettes 5 or money-receiving cassettes 4 for storing the bills every denomination.

Then, a money payment mode will be described. The bill-handling apparatus 8 takes bills equivalent to a designated mount of money from the recycle cassettes 5 for respective denominations. The bills thus separated pass through the transfer route 6 and denominations of the bills are judged by the discriminating device 2, and bills judged as normal bills are carried to the money-receiving/paying-out port 1 and paid out. Bills judged to be improper for payment due to a carrying state or bill condition are temporarily stored in the bill-receiving/discharging device 3. After the payment mode is effectuated, the improper bills are discharged from the bill-receiving/discharging device 3 and stored in the money-receiving cassettes 4 or recycle cassettes 5 after passing through the transfer route 6.

As described above, the bill-receiving/discharging device 3 of this embodiment is applied to a temporary stacker of the bill-handling apparatus 8 for temporarily storing bills before storing them in the money-receiving cassettes 4 or recycle cassettes 5.

Then, the embodiment of the bill-receiving/discharging device to which the invention is applied will be described.

Figure 1:
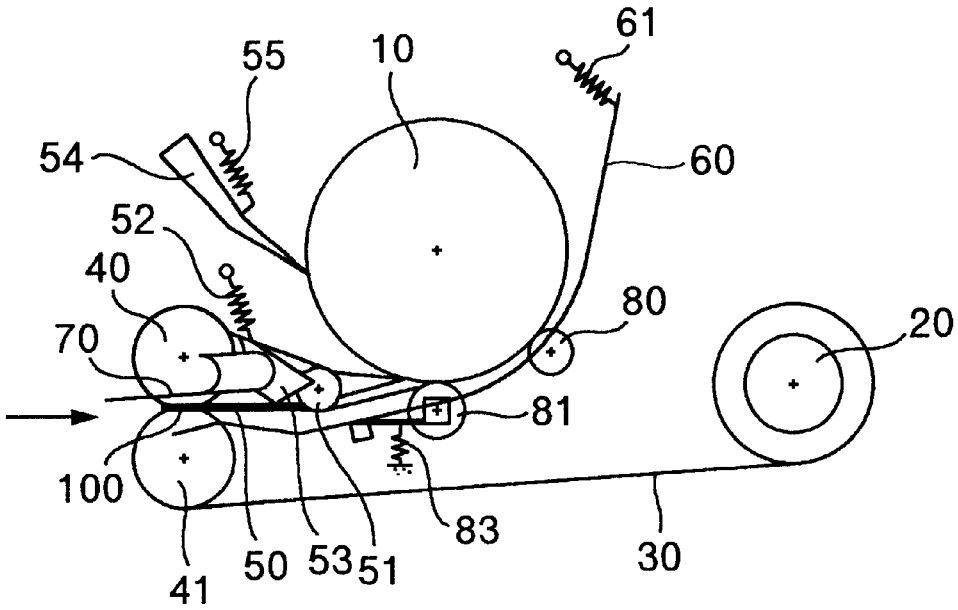
FIG. 1 is a side view showing an initial state of bill receiving of a bill-receiving/discharging device according to an embodiment of the invention.
Figure 2:
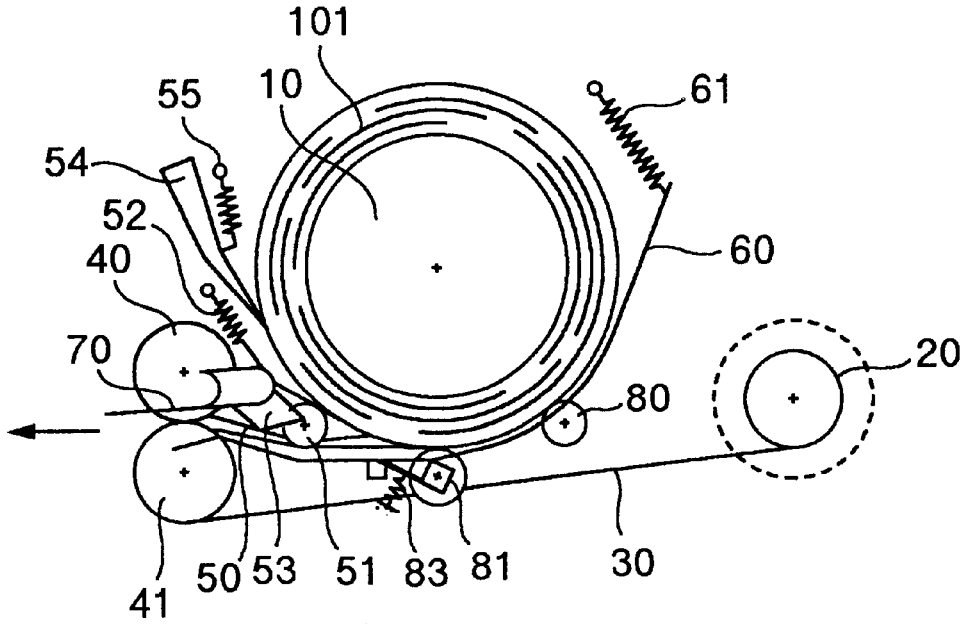
FIG. 2 is a side view showing a completion state of bill receiving of the bill-receiving/discharging device according to the embodiment of the invention.
Figure 3:
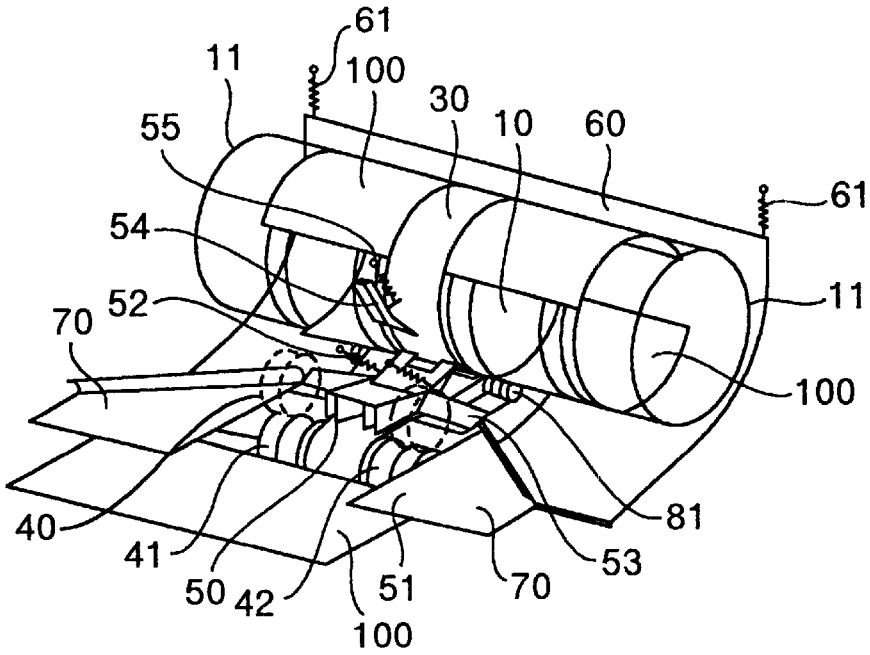
FIG. 3 is a perspective view showing the initial state of bill receiving of the bill-receiving/discharging device according to the embodiment of the invention.
Figure 4:
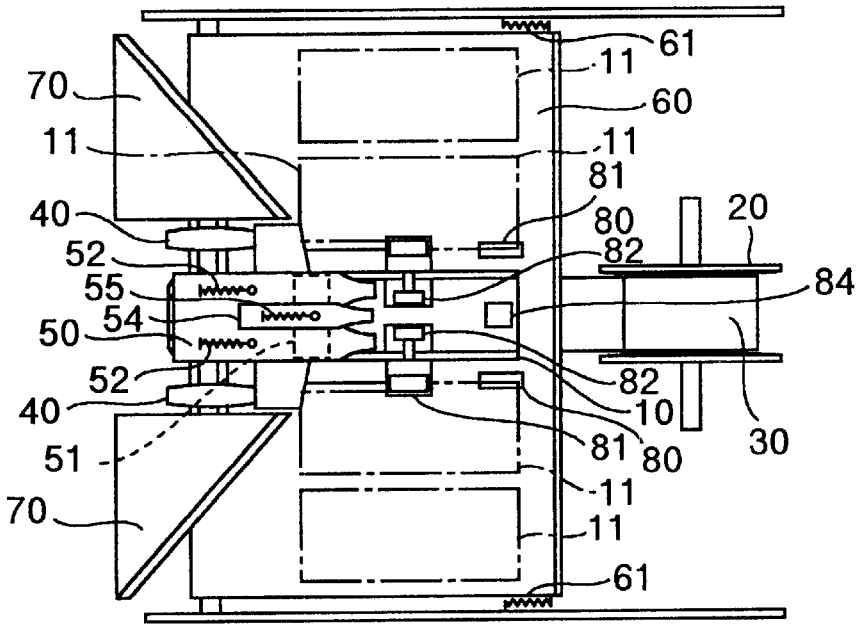
FIG. 4 is a top view showing the initial state of bill receiving of the bill-receiving/discharging device according to the embodiment of the invention.

FIG. 1 is a side view showing the entire configuration of the bill-receiving/discharging device 3 according to the embodiment of the invention. FIG. 2 is a side view showing a state in which a bill carried is stored in the bill-receiving/discharging device 3. FIG. 3 is a perspective view for explaining the configuration in FIG. 1, and FIG. 4 is a top view for explaining the configuration in FIG. 1. The configuration of the bill-receiving/discharging device 3 according to the embodiment of the invention will be described with reference to these FIGS. 1 to 4.

A reel 20 for fixing one end of a tape 30 is driven by a driving source, not shown. The other end of the tape 30, which tape is fixed to and wound round the reel 20, is fixed to the outer periphery of a wheel 10, and the wheel 10 is also driven by a driving source, not shown. By the way, a torque limiter, not shown, is provided on the rotating shaft of the reel 20. Arranging a motor for rotating the reel 20 through the torque limiter makes it possible to wind or rewind the tape 30 while always applying a tension to the tape 30 when receiving or discharging a bill.

The tape 30 wound on the reel 20 changes its direction through the outer periphery of an intermediate roller 42 and is wound by the wheel 10. The intermediate roller 42 is rotated by the friction with the tape 30 wound on its outer periphery, and the rotation of the roller 42 is controlled so that the winding speed of the tape 30 on the wheel 10 becomes constant. With these mechanisms, a bill 100 carried from the outside of the bill-receiving/discharging device 3 can be received by winding the bill together with the tape 30 on the outer periphery of the wheel 10 on which the tape 30 is wound.

In the bill-receiving/discharging device 3 described in the form of this embodiment, it is possible to securely receive or discharge bills of various denominations with different sizes mingled, as will be described below, even if only one tape 30 for winding bills is used. To receive bills of various denominations with different sizes mingled, it is necessary to determine the width of the tape 30 in accordance with sizes of bills to be handled.

Widths of the transfer route 6 and the transfer passage in the bill-receiving/discharging device 3 are decided correspondingly to a bill having the maximum longer-side length among those to be handled by the bill-handling apparatus 8. As bills to be handled are carried inside of the transfer route for them, the width of the tape 30 is decided so as to meet a condition of {(longer-side length Ls of bill having minimum longer-side length−transfer route width L/2)×2≧tape width S (however, Ls>L/2)} so that a bill having the minimum longer-side length among those to be handled can be normally received in the bill-receiving/discharging device 3 even if the bill is carried with maximum deviation from the center of the transfer route for the bill. By setting the width of the tape 30 in accordance with the above condition, it is possible to hold bills of various denominations with lengths different in the longer-side direction, which are carried through the bill transfer route described above, by the entire surface of the tape 30 in the axial direction of the wheel 10, and a gap is not formed between the tape 30 and the wheel 10 or the outer periphery of the tape 30 wound on the wheel 10 even if the tape 30 holds the bills. Therefore, it is possible to receive bills with no large deformation on the surface of the tape 30 on the outer periphery of the wheel 10.

It is preferable to set the width of the tape 30 to a large value because a bill can be more stably held as the width of the tape 30 increases and the distances between the holding portion and the ends of a bill decrease, and thereby it is possible to hold down the lifting of the bill ends. However, when the width of the tape 30 is set to a large value, a disadvantage occurs that the inertial load applied to rotation of the wheel 10 when winding the tape 30 increases by a value equivalent to the width of the tape 30. Accordingly, it is necessary to use the tape 30 having proper width and length. As a material of the tape 30, suited from the viewpoints of an inertial load and downsizing is a light-weight material superior in mechanical characteristic such as having a high strength even if the thickness of the material is small.

Moreover, because the tape 30 solely winds bills, it is preferable that the bills are wound together with the tape 30 by the wheel 10 at the central portion in the width direction of the bill transfer route through which the bills are carried for receiving and discharging.

On the rotating shaft of the wheel 10, auxiliary wheels 11 having a diameter almost equal to that of the wheel 10 are provided (depicted by only phantom lines in the axial direction of the wheel 10 in FIG. 3). The auxiliary wheels 11 may be designed to idle against the rotating shaft of the wheel 10 or may be fixed thereto. When the auxiliary wheels 11 can idle, it is possible to minimize the inertial load on the shaft of the wheel 10.

Carrying rollers 41 are fixed to the rotating shaft of the intermediate roller 42 on both sides thereof. Idling rollers 40 are disposed above the respective carrying rollers 41 in the figure, namely at positions opposite to the carrying rollers with the bill transfer route interposed therebetween, to contact the respective carrying rollers 41 under pressure. The carrying rollers 41 and the idling rollers 40 are rotated in accordance with the rotation of the intermediate roller 42.

A first scraper 50 is provided above the intermediate roller 42 in the figure, namely at a position facing the intermediate roller with the bill transfer route interposed therebetween, which position is between the pair of idling rollers 40. The first scraper swings about the axis of the idling rollers 40. Scraper guides 53, which will be described later in detail, are fixed to the both sides of the first scraper 50. The first scraper 50 is lifted upward in the figure by a first-scraper spring 52 so that the front end of the scraper 50 always contacts the surface of the tape 30 wound on the outer periphery of the wheel 10.

An auxiliary idling roller 51 is rotatably provided at an almost intermediate position of the first scraper 50, and a bill passes between the auxiliary roller 51 and the tape 30. The auxiliary roller 51 always contacts the tape 30 except the time when a bill passes. The auxiliary roller 51 is rotated by the friction with the tape 30.

A second scraper 54 is provided to be swingable about any fulcrum so that the front end of the scraper 54 always contacts the surface of the tape 30 wound on the outer periphery of the wheel 10 at a downstream position from the first scraper 50 as viewed in the direction of rotation of the wheel 10 when a bill is discharged. The second scraper 54 is lifted by a second-scraper spring 55 so that the front end of the scraper 54 always contacts the surface of the tape 30 wound on the outer periphery of the wheel 10.

In this embodiment, a bill guide 60 is provided to swing about the rotating shaft of the carrying rollers 41. The bill guide 60 serves to make a bill smoothly follow the outer periphery of the wheel 10 when the bill is received, and a part of the guide 60 is shaped in a circular arc larger than the maximum diameter of the wheel 10 when a maximum number of bills 101 is stored in the outer periphery of the wheel 10 as shown in FIG. 2. The guide 60 is imparted with a force applied in the direction toward the wheel 10 by a bill-guide spring 61.

Positioning rollers 80 are secured to the bill guide 60 so as to idle nearby the both sides of the tape 30 wound on the wheel 10. The positioning rollers 80 contact the outer peripheries of the associated auxiliary wheels 11 as shown in FIG. 4 or the surface of the bills 101 wound on the wheel 10 for storage together with the tape 30 to position the bill guide 60.

An auxiliary positioning roller 84, having a diameter smaller than that of the positioning roller 80, may be provided so as to idle on the rotating shaft of the positioning roller 80 at a position facing the tape 30. The auxiliary positioning roller 84, during continuously receiving bills, does not contact the outer periphery of the tape 30 when the level difference between the surface of the tape 30 wound on the outer periphery of the wheel 10 and the surface of the bills 101 wound on the outer periphery of the wheel 10 is smaller than a predetermined value. This is because the position of the bill guide 60 is decided by the positioning roller 80. However, when only the tape 30 is wound on the outer periphery of the wheel 10, or when the bills 101 is intermittently stored on the outer periphery of the wheel 10 and the level difference between the surface of the tape 30 wound on the outer periphery of the wheel 10 and the outermost periphery of the bills 101 stored on the outer periphery of the wheel 10 is larger than a predetermined value, the auxiliary positioning roller 84 contacts the surface of the tape 30 wound on the outer periphery of the wheel 10 to position the bill guide 60.

It is possible to position the bill guide 60 by only the auxiliary positioning roller 84. In this case, however, there is a fear that the auxiliary positioning roller 84 contacting the surface of the tape 30 will act as a friction member to have influence on the service life of the tape 30. Therefore, this embodiment is constructed so that the auxiliary positioning roller 84 contacts the tape 30 as less frequently as possible by positioning the bill guide 60 with the positioning roller 80 when bills are normally received or discharged.

Deformation rollers 81 are provided so as to idle nearby a contact point where the tape 30 leaves the outer periphery of the wheel 10 to the intermediate roller 42 and on the both sides of the tape 30. In this embodiment, the deformation rollers 81 are held on frames, which in turn are swingably supported by the bill guide 60, and lifted toward the wheel 10 by deformation-roller springs 83. Each deformation roller 81 comprises two-stage rollers of different diameters, or is shaped in a taper whose diameter decreases from the center of the device toward the outside. The central side of the lifted deformation roller 81, having a large diameter, enters the gap between the wheel 10 and an adjacent auxiliary wheel 11, and the outer side of the deformation roller 81, having a small diameter, contacts the outer periphery of the adjacent auxiliary wheel 11 while no bill is wound. Moreover, a restriction roller 82, having a diameter smaller than that of the deformation rollers 81, is provided so as to idle on the shaft of each deformation roller 81 at a position facing the central tape 30.

A bill discharging guide 70 is provided on the outer side of each idling roller 40 as viewed in the width direction of the transfer route. The bill discharging guides 70 serve to normally guide even a bill whose corner is highly lifted, which is stored by the tape 30, to the holding point of the idling rollers 40, which pressure-contact the carrying rollers 41, and to cause the bill to be normally discharged to the outside of the bill-receiving/discharging device 3. The bill discharging guides 70 will be described later in detail.

Now, a method of controlling the speed of the bill-receiving/discharging device 3 will be described. The carrying speed of the tape 30 is dependent on the rotation speed of the rotating shaft of the wheel 10 and its outer peripheral diameter. To keep the carrying speed constant, it is necessary to detect a change in the outer peripheral diameter of the wheel 10 and control the rotation speed of the rotating shaft of the wheel 10. However, as the outer peripheral diameter of the wheel 10 varies with the sizes of bills to be stored, the condition of bills and so on, it is difficult to estimate the outer peripheral diameter of the wheel 10 from the number of stored bills, and mechanically detecting the outer peripheral diameter of the wheel 10 results in a cost increase.

Then, as a method of controlling the carrying speed of the tape 30 within a predetermined value, the rotation speed of the wheel 10 is controlled by using changes in the number of revolution and the rotation speed of the reel 20. As the real 20 has only the tape 30 wound thereon, the length of the tape 30 paid out in the direction to the wheel 10 can be calculated from the number of revolution of the rotating shaft of the reel 20 based on the thickness of the tape 30. Therefore, by detecting the number of revolution of the reel 20 from its initial position as well as the time required for predetermined rotation by means of sensors, it is possible to estimate the diameter of the reel 20 and calculate the carrying speed of the tape from the time required for a predetermined number of revolution and the estimated length of the paid-out tape. The rotation speed of the rotating shaft of the wheel 10 is controlled in accordance with the calculated carrying speed, and it is possible to control the carrying speed of the tape 30 within a predetermined value.

The bill receiving operation will be described below. As shown by an arrow in FIG. 1, when the bill 100 is carried to the bill-receiving/discharging device 3 from the outside, the wheel 10 is rotated counterclockwise and the tape 30 wound on the reel 20 is taken up on the wheel 10.

The bill 100 carried from the outside of the bill-receiving/discharging device 3 is held together with the tape 30 by the idling rollers 40, which pressure-contact the respective carrying rollers 41, and carried in the direction to the wheel 10. Then, the bill is held by the tape 30 and the auxiliary roller 51, which is disposed on the tape 30 side of the first scraper 50, and wound and stored on the outer periphery of the wheel 10 together with the tape 30. The bill 100, when received, is guided by the bill guide 60 so as to smoothly follow the outer periphery of the wheel 10.

Through the operation described above, the bill-receiving/discharging device 3 can successively wind and store the bills 100, carried from the outside of the bill-receiving/discharging device 3, together with the tape 30 on the outer periphery of the wheel 10, and it is possible to store many bills 101 as shown in FIG. 2. Moreover, the diameter of the outer periphery of the wheel 10 increases due to the storage of the bills 101, and the first scraper 50, second scraper 54, bill guide 60, deformation rollers 81, and restriction rollers 82 rotate in accordance with the increase of the outer peripheral diameter.

The bill discharging operation will be described below. The rotating shaft of the reel 20 shown in FIG. 2 is rotated counterclockwise to rewind the tape 30, which has been wound on the outer periphery of the wheel 10 together with the bills 101 onto the reel 20 to discharge the bills 101 in the arrow direction.

Figure 7:
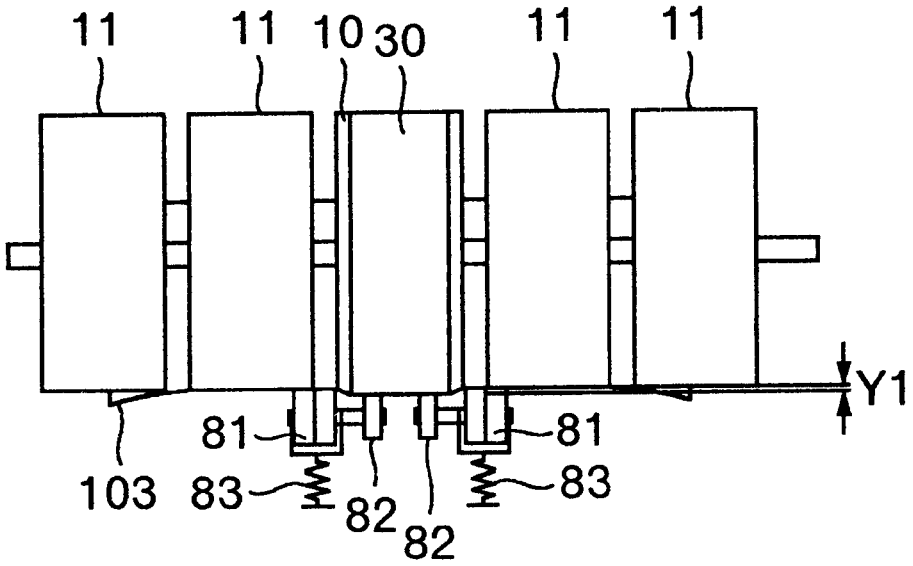
FIG. 7 is a front view showing the function of a deformation roller when discharging a bill.
Figure 9:
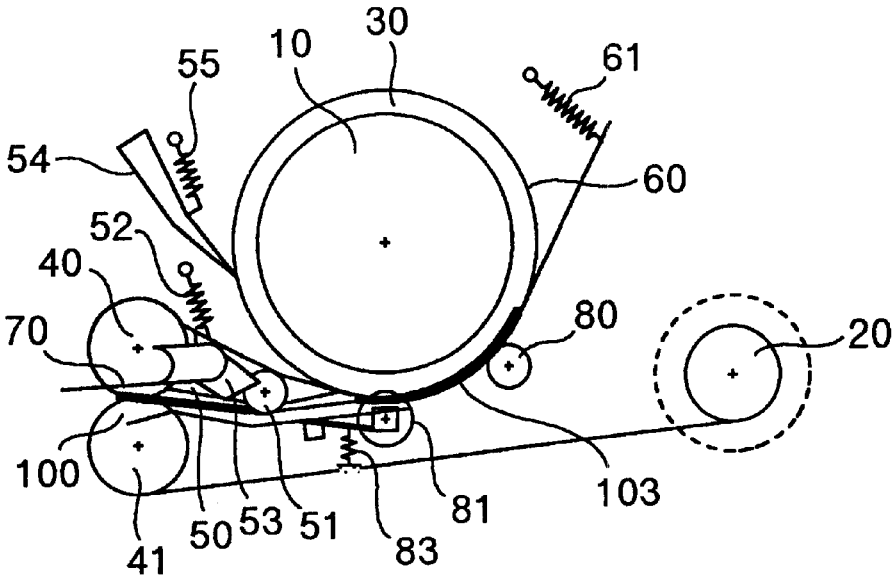
FIG. 9 is a side view when a bill is discharged in the embodiment of the invention.

Though will be described in detail later, when the bills 101 are discharged, the front end of a discharge bill 103 as viewed in the direction of discharge is corrugated or deformed into a wave shape by the right and left deformation rollers 81 as shown in FIG. 7 to separate the discharge bill 103 from the outer periphery of the wheel 10. The bill 103 is carried in the discharge direction while the wave-shaped deformation is applied, and the discharge bill is first moved to the bill transfer plane below the fist scraper 50. Then, the discharge bill 103 passes through the holding point between the auxiliary roller 51 and the tape 30 and is guided by the scraper guides 53 and the lower sides of the bill discharging guides 70 and discharged to the outside of the receiving/discharging device 3 in the arrow direction shown in FIG. 2 by the idling rollers 40 which pressure-contact the carrying rollers 41 (FIG. 9).

Then, the respective components will be described in more detail.

First, the bill discharging guides 70 and the scraper guides 53 will be described in detail. The discharging bill guides 70 and the scraper guides 53 of this embodiment are guide members provided as guide means for guiding a bill discharged together with the tape 30 let out from the wheel 10.

Figure 5:
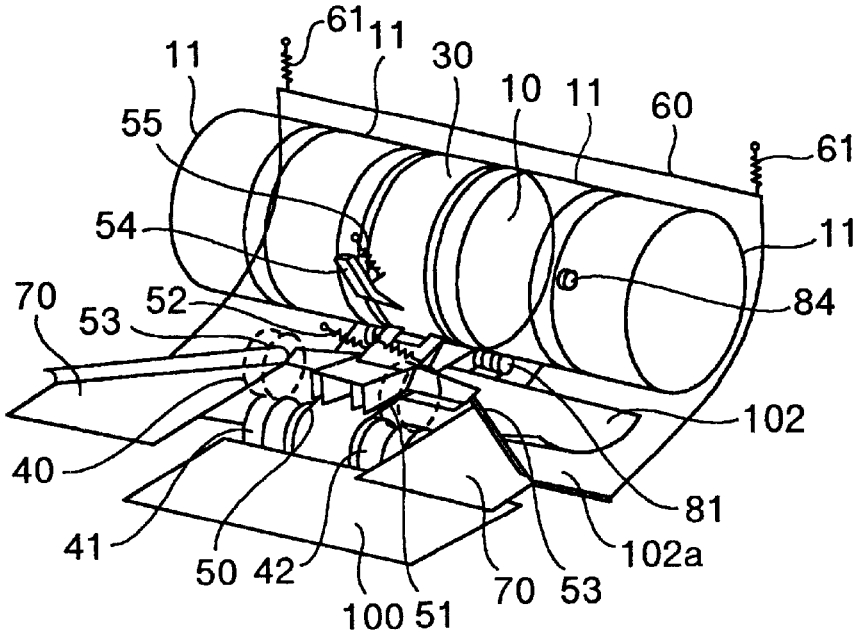
FIG. 5 is a perspective view when a curled bill is discharged from the bill-receiving/discharging device according to the embodiment of the invention.

A curled bill 102, having a habit of being rolled in the shorter-side direction of the bill, is discharged from the outer periphery of the wheel 10 in a state that the discharge bill 102 is greatly deviated from the center or tilted as shown in FIG. 5, and a corner of the bill 102, which is distant from the center in the axial direction, is highly lifted nearby the auxiliary roller 51. In this case, if no guide member is arranged, there is a fear that a trouble will occur that the front end on the discharge side of the curled bill 102 collides with the idling rollers 40 and the curled bill 102 is discharged with edge folding in which a corner of the bill 102 is folded like a triangle.

As the diameter of the outer periphery of the wheel 10 increases depending on the number of stored bills, it is impossible to dispose rollers, guides or the like serving as fixed holding means between the holding point by the wheel 10 (or the outer periphery of the tape 30 wound on the wheel 10 when the tape 30 is wound on the outer periphery of the wheel) and by the tape 30 and the holding point by the wheel 10 and by the idling rollers 40, which pressure-contact the carrying rollers 41, particularly inside a position where the outer diameter of the wheel 10 is maximized. Therefore, as a guide member, the scraper guides 53 are arranged on the both sides of the first scraper 50, which rotates along the outer periphery of the tape 30 wound on the wheel 10 in accordance with the number of stored bills.

The scraper guides 53 respectively tilt so that they separate from the bill transfer plane on the tape 30 on the wheel 10 side and on the idling roller 41 side from the vicinity of the center of the first scraper 50 as viewed in the bill carrying direction. Moreover, the position of the front end on the wheel side is determined so as to separate from the shaft of the wheel 10 from the center toward the outside as viewed in the axial direction.

Furthermore, the bill transfer face of each scraper guide 53 is so formed as to separate from the center of the wheel 10 according as it extends from the center to the outside as viewed in the axial direction in the state that the outer peripheral diameter of the wheel is maximum when bills are stored. With this construction, it is possible to carry a bill, which is held by the auxiliary roller 51 and tape 30, to the holding point of the idling rollers 40 pressure-contacting the carrying rollers 41 while preventing the bill from lifting at the both sides thereof by the scraper guides 53.

The scraper guides 53 may have a width equal to that of the bill transfer route in the axial direction. However, when the total weight of the first scraper 50 and the scraper guides 53 increases, there is a possibility that they will have influence on the function for separating the front end of a discharge bill from the outer periphery of the wheel 10, which is the original function of the first scraper 50, and it becomes difficult to completely bring the front end of the first scraper 50 into contact with the tape 30 wound on the wheel 10. In this case, it is preferable for each scraper guide 53 to have such a length in the axial direction as having no influence on the above function. Therefore, in this embodiment, the length is set to a length from the center up to the vicinity of the associated idling roller 41, using an end of a bill transfer route defined by the auxiliary roller 51, which is provided so as to face the tape 30, and the tape 30 as a start point.

Solely the scraper guides 53 thus formed short are insufficient to prevent the corner 102*a* of the bill 102 from lifting. Therefore, fixed guide means is arranged on both outer sides of the idling rollers 40 as viewed in the direction of width of the transfer route. In this embodiment, the bill discharging guides 70 are provided as a second guide member. Because the bill discharging guides 70 are stationary, their height from the bill transfer plane is fixed. However, the scraper guides 53 are secured to the first scraper 50 which is swingably supported, and it is necessary to consider the positional relation of the bill transfer plane between the scraper guides 53 and the bill discharging guides 70. This embodiment is so constructed that the positions of the scraper guides 53 on the bill transfer plane are nearer to the bill transfer plane than the positions of the bill guides 70 on the bill transfer plane side as shown in FIGS. 1 and 2.

Moreover, as shown in FIGS. 1, 3, and 4, the positions of the front ends of the bill discharging guides 70 on the wheel 10 side are so arranged as to further separates from the outer periphery of the wheel according as they extend outward from the center, and the front ends of the guides 70 on the wheel 10 side are shaped in a circular arc, which so tilts as to further separate from the bill transfer plane than portions of the guides 70 parallel with the bill transfer plane. Though the shape of the front ends of the guide 70 is not limited to a circular arc, it is preferable to form the shape so as to tilt while separating from the bill transfer plane.

Figure 6:
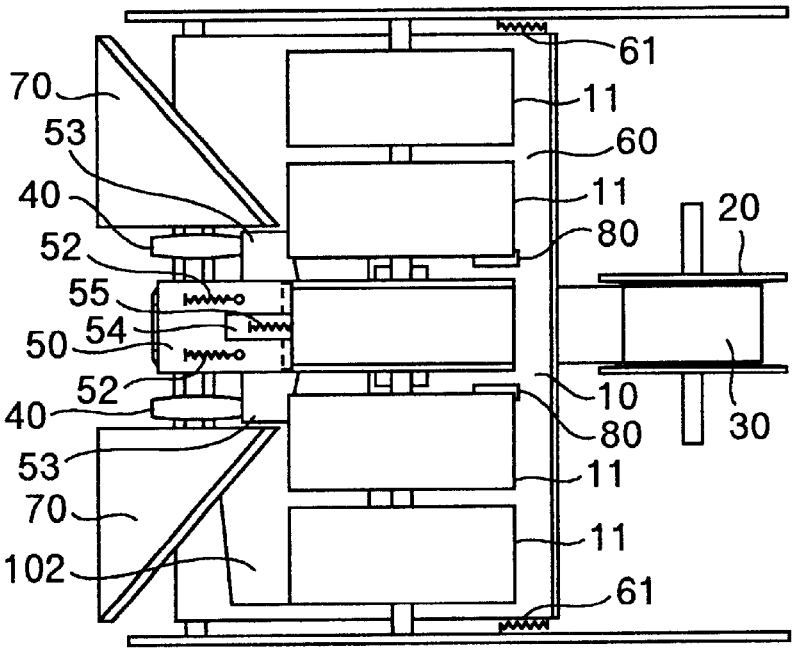
FIG. 6 is a top view when the curled bill is discharged from the bill-receiving/discharging device according to the embodiment of the invention.

By forming the guides in the above shape, it is possible to prevent the curled bill 102 from lifting by the scraper guides 53 from the both sides of the first scraper 50 where the front end of the bill 102 is less lifted in the direction of discharge of the bill 102 when the curled bill 102 is discharged to the outside of the device 3 as shown in FIGS. 5 and 6. Upon the curled bill 102 advances in the discharge direction, the front ends of the bill discharging guides 70 contact with the front end of the curled bill 102 at the center of the bill transfer route. Then, the contact point between the front ends of the bill discharging guides 70 and the curled bill 102 moves outward as the curled bill 102 is carried in the discharge direction, and corners of the curled bill 102 are prevented from lifting. The bill is finally guided to the holding point of the idling rollers 40 pressure-contacting the carrying rollers 41 while the corners are prevented from lifting. Thus, it is possible normally discharge the bill 102 to the outside of the receiving/discharging device 3.

The shape of the bill discharging guides 70 may be such that it tilts so that its distance from the bill transfer plane increases according as it extends to the wheel 10 and the fulcrum position of a tilt angle further separates from the center of the wheel 10 as the position moves outward from the center in the axial direction. However, there is a case where the bill corner 102*a* will considerably lift from the outer periphery of the wheel 10 due to the bill condition such as tilt, deviation, folds, or tearing of the bill stored on the outer periphery of the wheel 10. When the lifted portion of the bill contacts the bill discharging guides 70, a trouble will occur that a discharge bill is folded. Therefore, it is preferable for the bill discharging guides 70 to have the shape as shown in FIG. 3, which is in the position remove as far as possible from the wheel 10.

As having described above, the provision of the guide members, namely the scraper guides 53 and the bill discharging guides 70 makes it possible to provide a highly reliable bill receiving/discharging device capable of preventing a trouble such as edge folding that a corner of a bill is folded in a triangle when the bill is discharged.

Now, the deformation rollers 81 and the restriction rollers 82 shown in FIGS. 7 and 8 will be described in more detail. The deformation rollers 81 are bill-deformation members for applying a wave-shaped deformation to a bill let out together with the tape 30, and the restriction rollers 82 are restriction members for restricting the wave-shaped deformation to a bill within a certain magnitude.

Usually, when discharging a bill wound and stored on the outer periphery of the wheel 10, a wave-shaped deformation having a predetermined overlap value Y1 is applied to the front or leading end of the discharge bill 103 as viewed in the discharge direction by the right and left deformation rollers 81 as shown in FIG. 7. The wave-shaped deformation causes the discharge bill 103 to separate from the outer periphery of the wheel 10, and the bill is carried with the wave-shaped deformation remaining and guided between the first scraper 50 and the tape 30 so that the bill 103 can be normally discharged.

Figure 8:
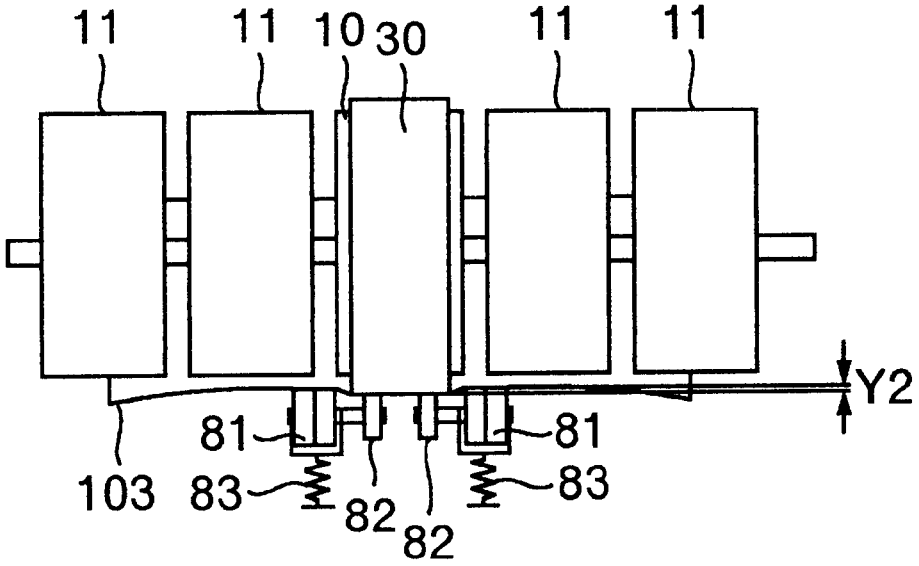
FIG. 8 is a front view showing the function of the deformation roller and that of a restriction roller when discharging the bill.

Moreover, as shown in FIG. 8, when a single bill is wound and stored on the outer periphery of the wheel 10 while only the tape 30 is wound on the outer periphery of the wheel 10, the right and left restriction rollers 82, which are arranged on extensions of the shafts of the deformation rollers 81, contact the outer periphery of the tape 30 wound on the outer periphery of the wheel 10 to position the deformation rollers 81. When the bill 103 is discharged in this state, the front end of the discharge bill 103 on the discharge side is deformed in a wave shape of an overlap value Y2 by the deformation rollers 81, and it is possible to normally discharge the bill 103 similarly to the case where the restriction rollers 82 do not contact the outer periphery of the tape 30.

The overlap of the deformation rollers 81 between the wheel 10 and the auxiliary wheels 11 provides a wave-shaped deformation of a level-difference value Y1 of the deformation rollers 81. However, as shown in FIG. 8, when only the tape 30 is wound on the outer periphery of the wheel 10 long, the level difference between the outer periphery of the tape 30 wound on the outer periphery of the wheel 10 and the outer periphery of the stored bills 103 increases, and an overlap value increases. To prevent such increase of the overlap value, it is preferable to use restriction members connected to the deformation rollers 81 so that they can be interlocked with the rollers 81. This embodiment uses the restriction rollers 82 as restriction members, which follow the deformation rollers 81 and swing. The restriction rollers 82 make it possible to decrease an overlap value within the level difference Y2 between diameter of the deformation rollers 81 and that of the restriction rollers 82 even if a wound bill is discharged in the state that only the tape 30 is wound on the outer periphery of the wheel 10.

Figure 10:
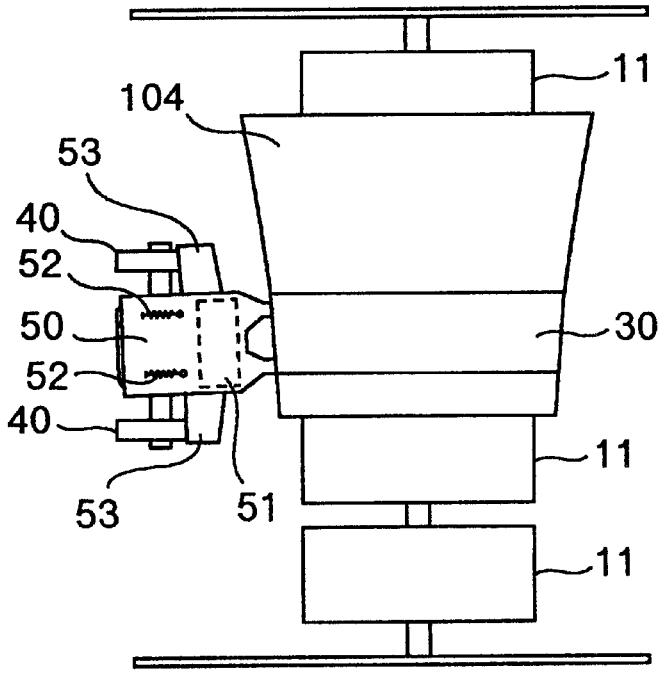
FIG. 10 is a top view for explaining a first scraper.

Next, the first scraper 50 will be described in more detail with reference to FIG. 10.

The first scraper 50 is a mechanism necessary as means for separating a discharge bill from the outer periphery of the wheel 10 as well as the deformation rollers 81. It is preferable to bring the first scraper into contact with at least a portion of the discharge bill 103, on which flexion is formed by the deformation rollers 81 and which separates from the tape 30. Moreover, by bringing the first scraper into contact with the outer periphery of the wheel 10 with less gap as little as possible, it is possible to normally discharge bills even if the deformation rollers 81 do not sufficiently work. In view of this, the front end of the first scraper 50 is formed at an acute angle and divided into two or more parts, and a margin in the torsional direction is provided to the shafts of the idling rollers 40 and the rotating shaft of the first scraper 50. With this construction, as shown in FIG. 10, even if a minimum bill 104 is stored while deviating from the wheel 10 and the outer periphery of the tape 30 wound on the wheel 10 is not parallel with the axial direction, the front end of the first scraper 50 can follow the outer periphery of the tape 30, and the above construction is effective to improve the following characteristic of the front end of the first scraper 50.

Figure 11:
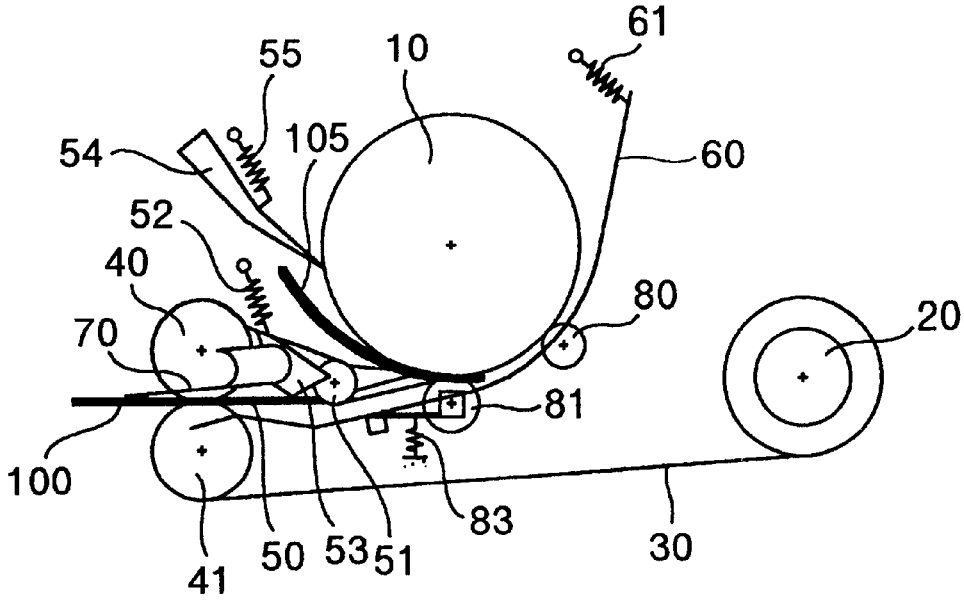
FIG. 11 is a side view for explaining a second scraper.
Figure 12:
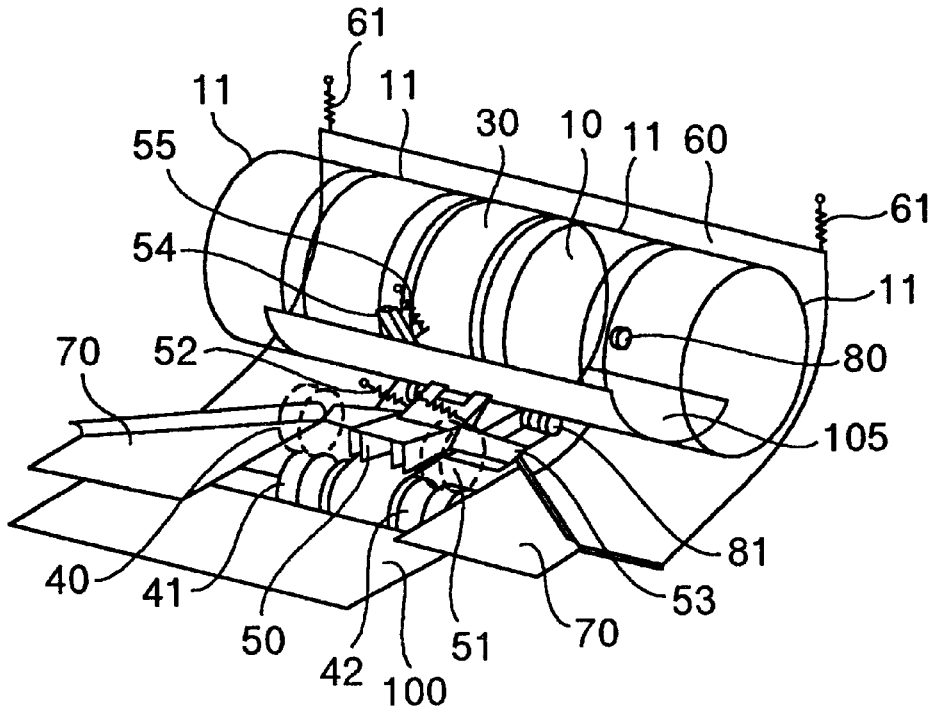
FIG. 12 is a perspective view for explaining the second scraper.

Subsequently, the second scraper 54 will be described in more detail with reference to FIGS. 11 and 12.

As described above, the deformation rollers 81 and the first scraper 50 are arranged to separate a discharge bill from the surface of the tape 30 wound on the outer periphery of the wheel 10. Further, in order to minimize damage when a trouble occurs that a discharge bill cannot be still separated and the discharge bill passes between the first scraper 50 and the outer periphery of the tape 30 wound on the wheel 10 as shown in FIGS. 11 and 12, the second scraper 54 is arranged so that its front end always contacts the outer periphery of the tape wound on the wheel 10 at a downstream position from the first scraper 50 as viewed in the direction of rotation of the wheel 10 when bills are discharged. A defective bill 105 passing through the first scraper 50 is separated from the outer periphery of the wheel 10 by the second scraper 54 again.

In a bill-handling apparatus on which the bill-receiving/discharging device of this embodiment is mounted, it is preferable to provide a sensor for detecting that the bill 105 contacts the second scraper 54 in order to avoid the normal operation in a state that the bill 105 passes through the first scraper 50. A detection result by the sensor is recognized by a controller for controlling operations of the bill-handling apparatus 8, and control is performed so as to stop at least the operations of the bill-receiving/discharging device 3. Moreover, control may be made such that operations of the apparatus 8 are stopped after stopping the operations of the bill-receiving/discharging device 3 when the controller recognizes the detection result by the sensor.

Thus, the provision of the means for detecting the contact of the bill 105 with the second scraper 54 prevents the worst case where the bill-receiving/discharging device 3 stands operated while the bill 105 attaches to the tape 30, the tape 30 is damaged and a lot of time is required for repair.

As having described in the embodiment of the invention, it is possible to provide a bill-receiving/discharging device which is of one-tape-winding system having the simplest configuration, improve the reliability of a bill-receiving/discharging device for carrying bills in the shorter-side direction thereof and is capable of storing or discharging even a small bill or a folded or curled bad-condition bill.

As described above, according to the present invention, a highly reliable bill-receiving/discharging device can be realized.

What is claimed is:

1. A bill-receiving/discharging device comprising:

a wheel for winding a tape together with bills at a central portion in a direction of a width of a bill transfer route through which the bills are carried in a shorter-side direction thereof;

a reel for winding the tape let out from the wheel; and guide means for guiding front ends of the bills discharged together with the tape let out from the wheel to a transfer plane of the bill transfer route;

wherein the guide means is disposed on an opposite side of the transfer plane of the bill transfer route from the tape and on both sides of the tape in a longer-side direction of the bills.

2. A bill-receiving/discharging device according to claim 1, wherein the guide means includes:

first guide means movable when an outer diameter of the wheel varies due to winding of the tape; and fixed second guide means.

3. A bill-receiving/discharging device comprising:

a wheel for winding a tape together with bills at a central portion in a direction of a width of a bill transfer route through which the bills are carried in a shorter-side direction thereof;

a reel for winding the tape let out from the wheel; and guide means for guiding front ends of the bills discharged together with the tape let out from the wheel to a transfer plane of the bill transfer route;

wherein the guide means includes a guide member having a shape in which an end of the member on a wheel side extends in the width direction of the bill transfer route from an end of the tape in a direction of a width thereof and gradually separates from a rotating shaft of the wheel outward in the width direction of the bill transfer route from the vicinity of a center of the bill transfer route according as a discharged bill is carried.

4. A bill-receiving/discharging device comprising:

a wheel for winding a tape together with bills at a central portion in a direction of a width of a bill transfer route through which the bills are carried in a shorter-side direction thereof;

a reel for winding the tape let out from the wheel; and guide means for guiding front ends of the bills discharged together with the tape let out from the wheel to a transfer plane of the bill transfer route;

wherein the guide means includes first guide means movable when an outer diameter of the wheel varies due to winding of the tape, and fixed second guide means; and wherein the first guide means includes a guide member which is supported so as to follow a change in the outer diameter of the wheel due to winding of the tape and contact an outer periphery of the tape wound on the wheel and is arranged on a scraper portion for guiding bills discharged as the tape is let out from the wheel.

5. A bill-receiving/discharging device according to claim 4, further comprising bill-deformation members disposed on both sides of the tape and near a contact point between the tape let out from the wheel and the outer periphery of the wheel to apply a wave-shaped deformation to a bill let out together with the tape from the wheel.

6. A bill-receiving/discharging device according to claim 5, further comprising a restriction member which is connected with the bill-deformation members so that the restriction member can be interlocked with the bill-deformation members and contacts an outer periphery of the wheel to follow a change in an outer diameter of the wheel to restrict the wave-shaped deformation applied to a bill within a certain magnitude.

7. A bill-receiving/discharging device according to claim 4, further comprising a second scraper portion which is located downstream from a contact position of the first scraper portion to the outer periphery of the wheel as viewed in a direction of rotation of the wheel for letting out the tape to contact the outer periphery of the wheel.

8. A bill-receiving/discharging device comprising:

a wheel for winding a tape together with bills at a central portion in a direction of a width of a bill transfer route through which the bills are carried in a shorter-side direction thereof;

a reel for winding the tape let out from the wheel; and guide means for guiding front ends of the bills discharged together with the tape let out from the wheel to a transfer plane of the bill transfer route wherein the guide means includes first guide means movable when an outer diameter of the wheel varies due to winding of the tape, and fixed second guide means;

wherein the bill-receiving/discharging device further comprises:

a first roller located between the reel and the wheel and contacting under pressure with the tape let out from the wheel to change a direction of the tape;

a second roller fixed on a rotating shaft of the first roller and located on a belt side of the second guide means to rotate in accordance with rotation of the first roller; and a third roller contacting under pressure with the second roller to rotate; and wherein the second roller and the third roller hold the bills discharged due to a tape letting-out operation of the wheel to apply a carrying force to the bills.

9. A bill-handling apparatus comprising:

a bill-handling port for receiving and paying out bills;

a transfer route for carrying the bills to the bill-handling port in a shorter-side direction of the bills;

a discriminating device for discriminating the bills carried through the transfer route;

a storing cassette connected with the transfer route for storing bills so that the bills can be let out; and a bill-receiving/discharging device for temporarily storing the bills judged by the discriminating device;

wherein the bill-receiving/discharging device includes a wheel for winding a tape together with the bills at a central portion in a direction of a width of the transfer route through which the bills are carried in a direction of a shorter side thereof, a reel for winding the tape let out from the wheel, and guide means for guiding front ends of the bills discharged together with the tape let out from the wheel in a direction of a transfer plane of the bill transfer route; and wherein the guide means is disposed on an opposite side of the transfer plane of the bill transfer route from the tape and on both sides of the tape in a longer-side direction of the bills.

10. A bill-handling apparatus comprising:

a bill-handling port for receiving and paying out bills;

a transfer route for carrying the bills to the bill-handling port in a shorter-side direction of the bills;

a discriminating device for discriminating the bills carried through the transfer route;

a storing cassette connected with the transfer route for storing the bills so that the bills can be paid out; and a bill-receiving/discharging device for temporarily storing the bills judged by the discriminating device;

wherein the bill-receiving/discharging device includes a wheel for winding a tape together with the bills at a central portion in a direction of a width of the transfer route through which the bills are carried in a direction of a shorter side thereof, a reel for winding the tape let out from the wheel, guide means for guiding front ends of the bills discharged together with the tape let out from the wheel in a direction of a transfer plane of the bill transfer route, and a bill-deformation member disposed for idling nearby a contact point between the tape let out from the wheel and an outer periphery of the wheel and nearby both sides of the tape to apply a wave-shaped deformation to the bills paid out from the wheel together with the tape; and wherein the guide means includes first guide means movable when an outer diameter of the wheel varies due to winding of the tape, the first guide means including a first guide wound on the wheel, the first guide member being arranged on a scraper portion which guides the bills discharged as the tape is let out from the wheel to the bill transfer route, tilting so as to separate from the bill transfer plane on the tape on the wheel side in a direction of transfer of the bills, a front end of the first guide member being located so as to further separate from an axis of the wheel according as extending outward from the center in an axial direction, and fixed second guide means, the second guide means including a second guide member formed so that its front end on the wheel side is located as to further separate from the outer periphery of the wheel according as extending outward from the center.

* * * * *